US005588803A

United States Patent [19]

Vetter et al.

[11] Patent Number: 5,588,803

[45] Date of Patent: Dec. 31, 1996

[54] CENTRIFUGAL IMPELLER WITH SIMPLIFIED MANUFACTURE

[75] Inventors: Stephan M. Vetter, Lockport; Mark J. Parisi, East Amherst, both of N.Y.

[73] Assignee: General Motors Corporation, Detroit, Mich.

[21] Appl. No.: 566,101

[22] Filed: Dec. 1, 1995

[51] Int. Cl.[6] ..... F04D 29/28

[52] U.S. Cl. ..... 416/186 R; 416/186 A; 416/188; 29/453; 29/889.21

[58] Field of Search ..... 416/186 R, 186 A, 416/188, 187, 178, 189, 192, 195, 190, 223 B, 234, 241 A; 29/453, 889.21

[56] References Cited

U.S. PATENT DOCUMENTS 4,569,632 2/1986 Gray, III .
4,900,228 2/1990 Yapp .
4,917,572 4/1990 Van Houten .
4,946,348 8/1990 Yapp .
4,971,520 11/1990 Van Houten ..... 416/189
5,328,332 7/1994 Chiang ..... 416/186 R

FOREIGN PATENT DOCUMENTS 0153221 8/1985 European Pat. Off. ..... 416/186 R

*Primary Examiner*—Edward K. Look
*Assistant Examiner*—Christopher Verdier
*Attorney, Agent, or Firm*—Patrick M. Griffin

[57] ABSTRACT

A centrifugal blower impeller has wide, backwardly inclined blades of the type that require the addition of a locking ring in order to stiffen and stabilize the blade tips. The blade tips and locking ring incorporate special notches and interfitting channels that allow the locking ring to be simply pushed down and onto the blade tips, self retaining without the necessity of any extra assembly steps like staking or welding. The side edges of the blade tip notches wedge against the walls of the channels if the blade tip attempts to bend in either direction.

1 Claim, 4 Drawing Sheets

CENTRIFUGAL IMPELLER WITH SIMPLIFIED MANUFACTURE

This invention relates to centrifugal blowers in general, and specifically to such a blower that simplifies the means by which the blower blade tips are supported and stabilized.

BACKGROUND OF THE INVENTION

The most familiar air moving mechanism is the simple axial fan, which is the stationary equivalent of an airplane propeller. Whether used for residential cooling or automotive radiator cooling, it simply pulls air axially straight through it. Less familiar is the so called centrifugal blower, which finds common usage in vehicle HVAC systems. A centrifugal blower has a generally cylindrical impeller rotating in one direction that pulls air in along its central axis as it rotates, but then forces it radially outwardly, turning it ninety degrees, in effect. A scroll shaped blower housing surrounding the impeller collects and confines the expelled air and sends it through a tangential outlet to the rest of the HVAC system.

The basic cylindrical impeller includes a central hub, often dome shaped, through which a motor drive shaft is attached, and a flat, annular outer rim. Extending upwardly from the hub rim are an evenly spaced series of identical blades, which are parallel to the central axis. While the blades have a radial component, when viewed axially, they seldom lie right on radial planes, like a simple paddle wheel, but are generally sloped away from a radial plane, in one direction or the other. That overall blade slope or incline may run either toward the direction of rotation, called forwardly curved or inclined, or away from the direction of rotation, called rearwardly curved or inclined. "Inclined" is a more useful term to describe the blade angle, since the blades are seldom flat, either, and may be concave, convex, or an S shaped combination of the two. This concavity-convexity may be thought of as a "curve" of the blade, as distinct from its overall slope or inclination relative to the direction of rotation. In general, rearwardly inclined blades are more nearly flat than forwardly sloping blades, which are often distinctly concave or scoop shaped. There are known advantages and disadvantages to both types of blade. Rearwardly inclined blades are known to produce a pressure differential that is more static than dynamic, and are self limiting in their power demand at high impeller speeds. A disadvantage of rearwardly inclined fans is that it is more critical to preserve that high static pressure by limiting potential leak paths at the interface between the impeller and blower housing.

Another consideration with either type of impeller, but especially with rearwardly inclined blades, is ease of manufacture. In automotive applications, only molded plastic impellers with a minimum number of parts and assembly steps are cost effective. As will be recognized by those skilled in the molding art, the most cost effective way to mold plastic is by the so called axial draw technique, which uses only two molds that part along a natural axis of the component. It is possible to mold a centrifugal blower impeller's hub, hub rim, and blades all in one piece, with molds parting along the hub central axis. This is because the outer surfaces of the blade all run parallel to that central axis, with no undercuts. The bases of the blades are integrally molded to the hub rim, but the tips of the upstanding blades are unsupported and free. Without stiffening support of some sort, the blade tips and blades would twist and flex unacceptably in operation. It is possible to tie the blades together and stiffen them, to an extent, with a thin, circular end band that surrounds the outer edges of the blades, near the tips. Such an end band is everywhere larger in diameter than the outer edge of the hub rim. It therefore does not radially overlap with the central hub's rim at all, and may be molded integrally to and with the impeller, by the same two molds. An end band, which touches only the outer blade edge, can provide enough tip support for narrower, forwardly inclined blades, whose sharp concavity also gives them enough inherent stiffness to resist twisting in operation. However, rearwardly inclined blades have a much greater radial extent, as measured from inner to outer edge, and a consequently much wider unsupported tip. They also generally have much less "curvature" to help stiffen them. Consequently, a separate stiffening ring, axially opposed to and overlaying the hub rim, has generally been secured to the blade tips. The stiffening ring can also help to control pressure leakage between the impeller and the edge of the housing inlet. The stiffening ring has a radial width comparable to the hub rim to which it is axially opposed, overlapping it almost completely. It therefore cannot be molded integrally to the rest of the impeller, and has to be manufactured separately. It is generally staked to each separate blade tip, a time consuming and expensive assembly step.

SUMMARY OF THE INVENTION

The invention provides a centrifugal blower impeller design which stiffens the blades with a ring that can be easily manufactured and more simply attached to the blades.

In the embodiment disclosed, the centrifugal blower includes an essentially conventional scroll shaped housing with central axial inlet and tangential outlet. A conventional dome shaped central hub and annular rim comprise the lower end of the impeller. A series of identical, circumferentially spaced blades extend up from the rim, solidly supported at the lower end, but free at the tip. The blades are rearwardly inclined, with a large edge to edge radial width, and nearly flat, so as to have low inherent stiffness. To provide extra stiffness, a novel locking ring interfits with a special blade tip shape. The tip of each blade includes a pair of widely radially spaced notches, each of which opens axially. The shape of the hub, blades and blade tip notches is such that the hub and blades may be integrally molded with just two axially parting molds. The locking ring is an annular plate with a width just greater than the blade tips. The underside of the locking ring is molded with a pair of annular channels which, in cross section, have an outer shape closely matching the inner shape of the blade notches. The shape of the locking ring is such that it may be molded in the same fashion as the hub and blades.

The matching shape of the locking ring channels and the blade tip notches allows the impeller to be assembled simply by pushing the underside of the locking ring axially down into the blade tip notches with a tight interference fit, locking the blade tips into position. No staking or other securement steps are needed. When the impeller is installed into the housing, the inner edge of the locking ring creates a close clearance with the housing inlet, limiting pressure leakage back into the housing inlet. As the impeller rotates, the blades are prevented from twisting by the tight fit of the channels within the spaced apart notches. The locking ring tends to wedge into the side edges of the blades if forces tend to bend the blade tips in either direction. Therefore, the ring is well secured even without staking or other extra securement operations.

DESCRIPTION OF THE PREFERRED EMBODIMENT

These and other features of the invention will appear from the following written description, and from the drawings, in which.

Figure 1:
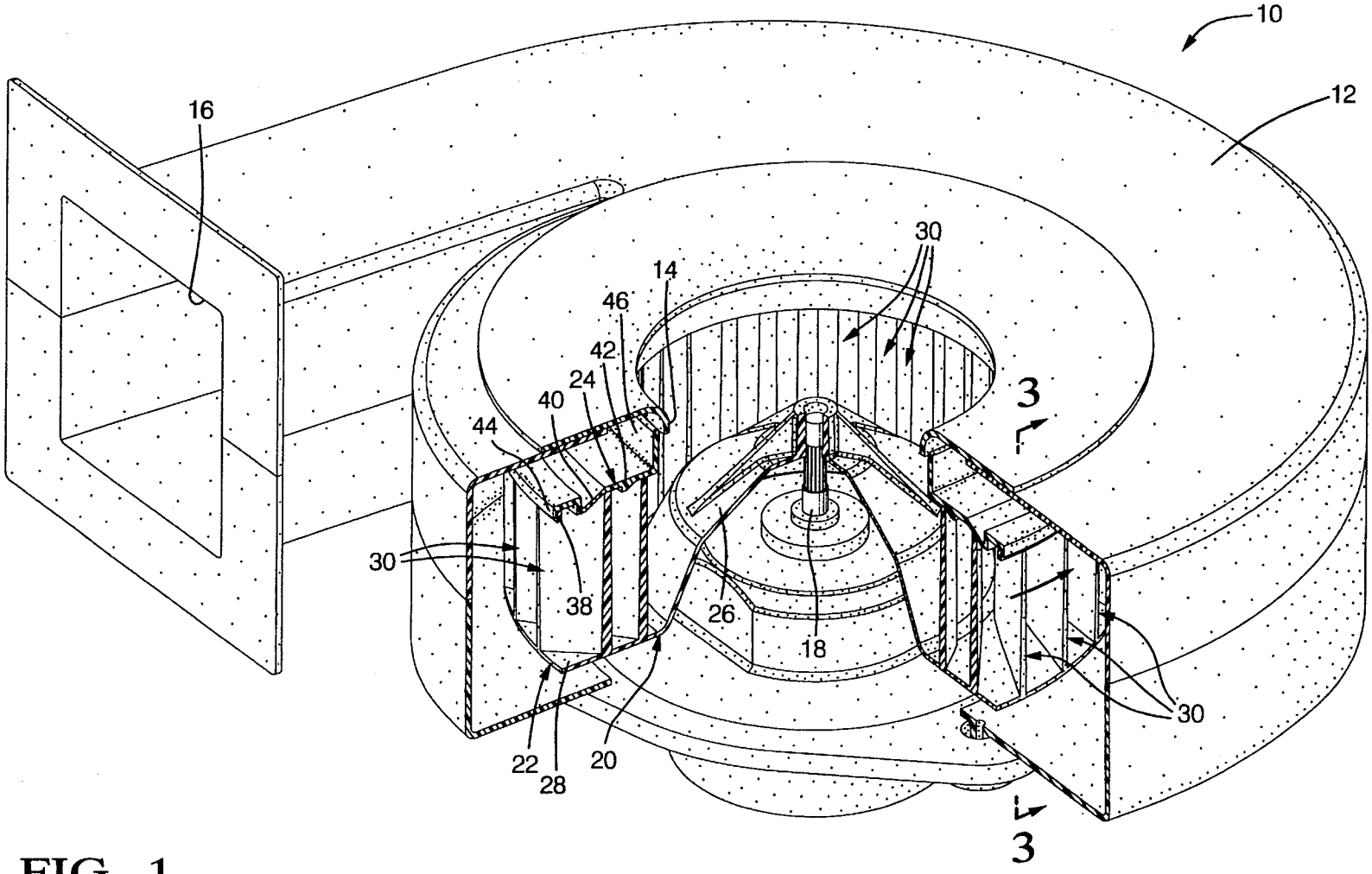
FIG. 1 is a perspective view of a centrifugal blower having an impeller made according to the invention, with a quarter section of the blower housing and impeller cut away.
Figure 6:
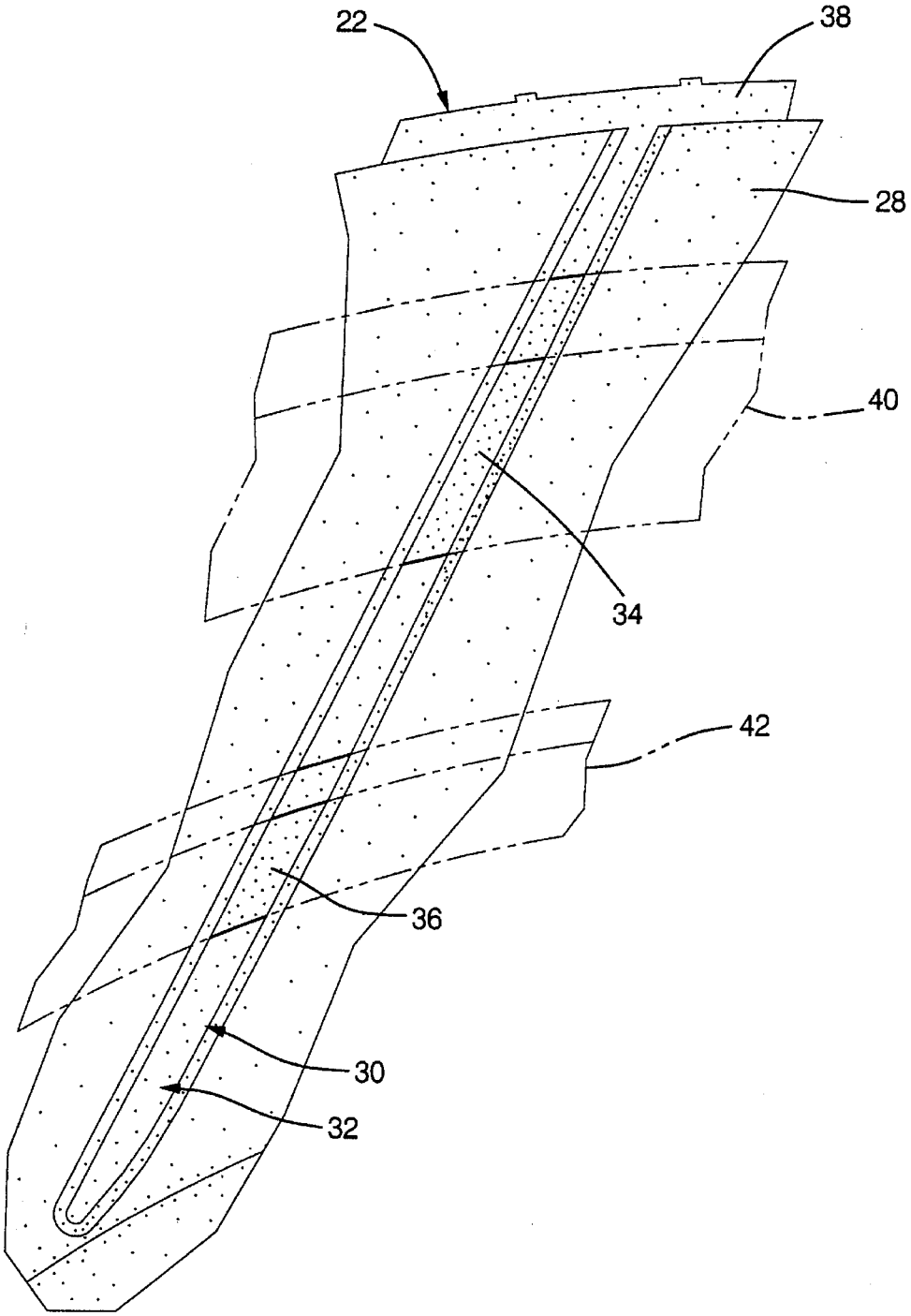

FIG. 6 is an enlarged axial view of one blade tip, showing the location of the locking ring channels in dotted lines; and Referring first to FIG. 1, a centrifugal blower is indicated generally at 10. Blower 10 includes a scroll shaped housing 12, with a central, axial air inlet defined by a downturned cylindrical lip 14 and a tangential outlet 16. A central motor driven shaft 18 lies on the center axis of inlet lip 14, to which is secured the impeller of the invention, a first embodiment of which is indicated generally at 20. As impeller 20 spins, counterclockwise from the perspective of FIG. 1, outside air is drawn axially in through the inlet lip 14. Indrawn air is then pushed radially outwardly, swirling around counterclockwise between impeller 20 and the wall of housing 12 until it exits tangentially through outlet 16. While impeller 20 does not operate differently in terms of air handling, its structure allows it to be manufactured and assembled in a simpler and less costly manner.

Figure 2:
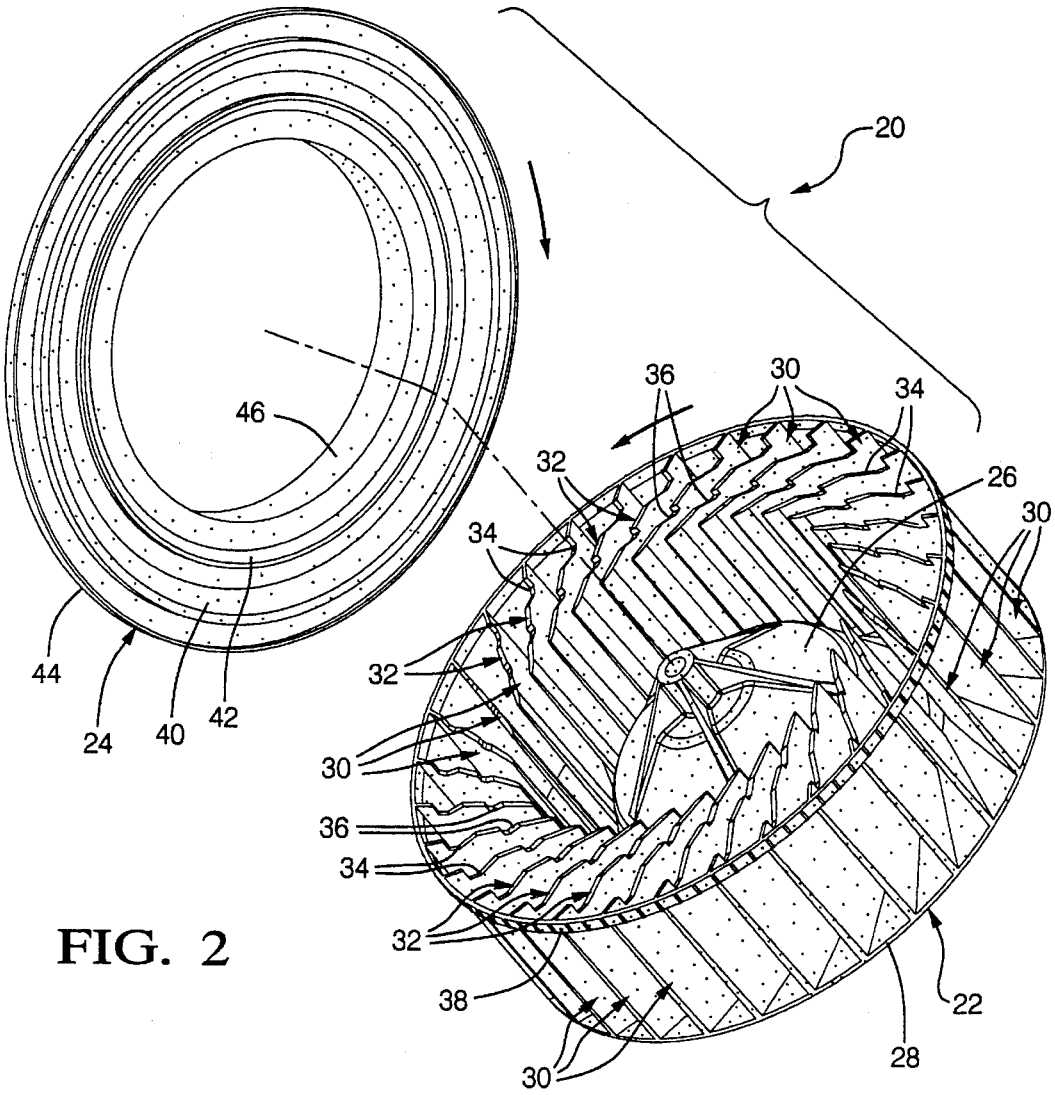
FIG. 2 is a perspective view of the molded fan hub and blades with the locking ring removed, and showing the undersurface of the ring.
Figure 3:
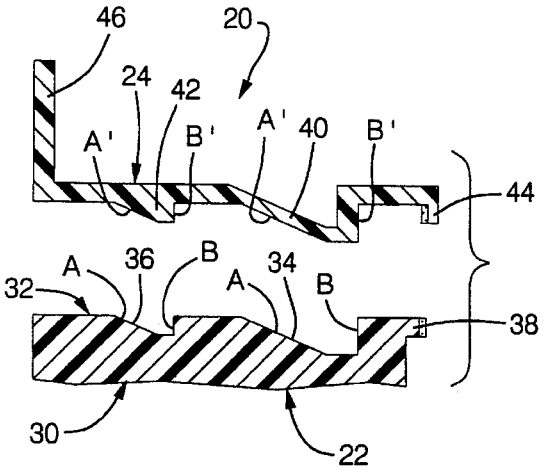
FIG. 3 is a cross section of the end of one impeller blade, looking in the direction of the rotation arrow, and a matching cross section of the locking ring taken along the line 3—3 of FIG. 1.
Figure 4:
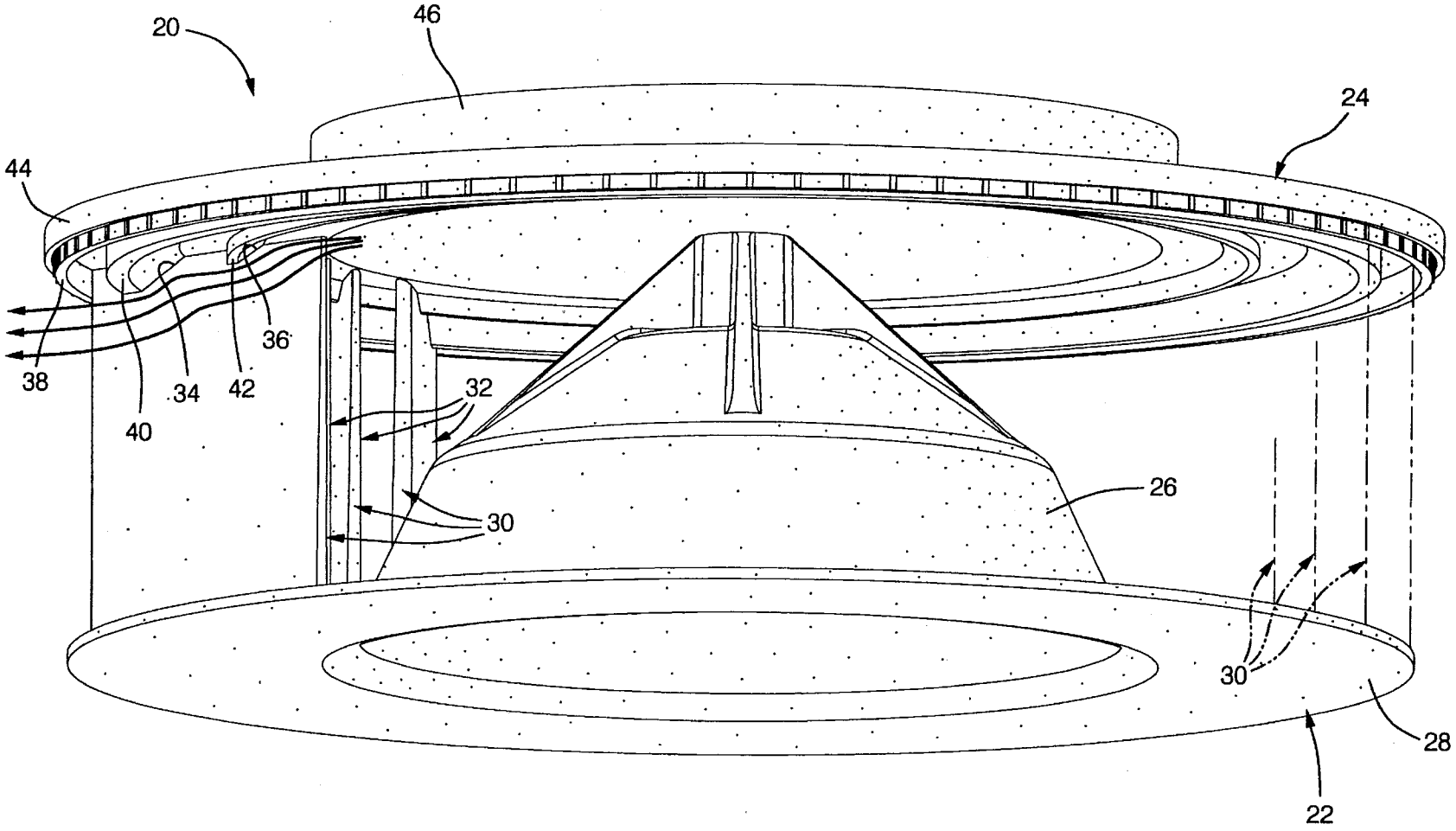
FIG. 4 is a perspective view of the undersurface of the impeller locking ring with most of the blades removed, so as to better illustrate the interfit of the blade tips to the locking ring.

Referring next to FIGS. 2 through 4, impeller 20 is comprised of only two integrally molded plastic components, a hub and blade assembly, indicated generally at 22, and a locking ring, indicated generally at 24. Hub and blade assembly 22 is comprised of a central, domed hub 26 and an integral, annular rim 28, which is coaxial to the axis of motor shaft 18. Extending upwardly from hub rim 28 are an evenly spaced array of blades 30, which are integrally molded to the hub rim 28 at the base, but which are substantially free and unsupported at the tip 32. The blades 30 are radially wide enough, and flat enough, such that they would, without external support at the tips 32, flex and bend excessively in operation. As best seen in FIGS. 1 and 2, each blade 30 is rearwardly inclined and slopes away from the direction of rotation. The blade tips 32 all have a pair of axially opening, widely radially spaced notches, including larger, deeper notches 34 near the radially outer edge and smaller, shallower notches 36 near the radially inner edge. The notches 34 and 36 are similar in shape, each having a shorter, almost vertical side edge B and a shallower, longer side edge A, with a flat bottom edge. While the blade tips 32 are mostly unsupported, their outer edges are tied together by a radially thin and axially narrow circular band 38, which is knurled on its outer surface. The defining feature of band 38 is that it is located entirely radially outboard of, and thus has no radial overlap with, the axially opposed hub rim 28. As a consequence band 38, along with the blades 30, hub rim 28 and hub 26, can all be integrally molded by a single pair of molds that part along the central axis of hub 26. However, band 38, since it must be radially thin, cannot alone provide adequate stiffening to the blade tips 32. Any structure capable of providing sufficient blade support would have to intrude radially inwardly along the width of the blade tips 32, radially overlapping the rim 28, and would, therefore, be impossible to integrally mold by the same technique.

Referring next to FIGS. 2 and 3, locking ring 24 is an annular part, also integrally molded of plastic, with a size and width roughly comparable to the hub rim 28. The undersurface of ring 24 is molded with two generally circular or annular channels. These include a wider, hollow channel 40 near the radially outer edge that matches the shape of wider blade tip notch 34, and a narrower, solid channel 42 that matches the shape of the thinner blade tip notch 36. As such, in a cross section taken in the same plane in which a blade tip 32 generally lies, each channel 40 and 42 has a longer, conical wall A', matching the corresponding notch edges A, and a shorter, cylindrical wall B' matching the notch edges B. This can be best seen in FIG. 3. Ring 24 has two other structural features. One is a thin, depending cylindrical flange 44 on the radially outer edge, which has an inner diameter substantially equal to the outer diameter of band 38, and which is knurled on its inner surface to match the knurling on the outer surface of band 38. At the radially inner edge is an upstanding cylindrical wall 46, with a diameter just less than the inner diameter of housing inlet lip 14. It will be recognized that all the exterior surfaces of ring 24 have the same basic inter relationship as the hub and blade assembly 22 and can, therefore, be integrally molded by the same two mold technique.

Figure 5:
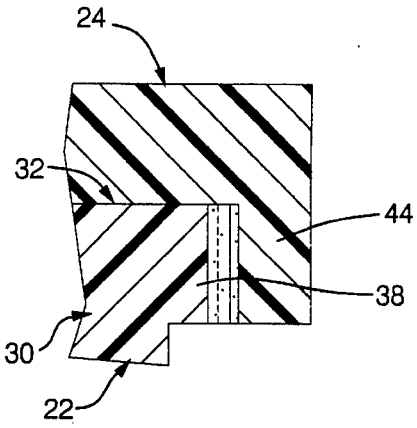
FIG. 5 is an enlarged cross section through the outer edges of the blade tips and the locking ring.

Referring next to FIGS. 3 through 6, the assembly and operation of impeller 20 is described. By simply aligning ring 24 coaxially with the hub and blade assembly 22 and pushing them axially together, the ring flange 44 will slide tightly over the band 38, as best seen in FIG. 5. Concurrently, the channels 40 and 42 press firmly into the corresponding notches 34 and 36, as best seen in FIG. 4, to complete the impeller 20. No specific angular orientation of the ring 24 relative to the blade tips 32 is necessary, since they match at every point. The mating surfaces of the knurled flange 44 and band 38 fit tightly enough to prevent the ring 24 from detaching, so no other attachment step is necessary, such as welding, staking or gluing. It is also not necessary, therefore, that the channels 40 and 42 fit into the notches 34 and 36 so tightly as to prevent detachment of ring 24, although they do fit very snugly. What the channels 40 and 42 do accomplish, however, is to stiffen and support the blade tips 32, even though they are not directly physically attached thereto, as a conventional ring would be. This is best illustrated in FIG. 6, which shows just one blade 30, and which shows the relative locations of the walls A' and B' of the channels 40 and 42 in dotted lines. The situation is the same for all identical blades 30, of course. As the impeller 20 is rotated counterclockwise, the air that the blades 30 contact reacts in the opposite direction, as shown by the arrows. Without support, this would tend to bend the blade tip 32, and therefore the entire blade 30, to the right about its juncture with the band 38. As a blade tip 32 is forced so as to bend to the right, both of the longer, radially inner notch edges A can bend away from the corresponding channel side walls A', which are geometrically diverging therefrom at that point, given the backward slope of the blade tip 32. However, the shorter, radially notch side edges B are concurrently jammed into the corresponding channel side walls B', which converge toward the notch edges B. This jamming or wedging action, at each of the widely separated notches 34 and 36, prevents the blade tip 32 from bending, stiffening the entire blade 30. The converse occurs in the case of any forces tending to bend the blade tip 32 to the left, in which case the longer notch edges A create the wedging action.

Referring next to FIGS. 1 and 4, other features of the impeller 20 are illustrated. When impeller 20 is secured to shaft 18 within housing 12, and spun in the direction of the arrow, air is drawn axially down through the inlet lip 14, and then pushed radially outwardly, creating an elevated pressure between the outer edges of the blades 30 and the wall of the housing 12. The cylindrical wall 46 is disposed very close to the inlet lip 14, leaving a tightly controlled radial gap that limits pressure leakage back into the inlet 14. The specific shape and size of the channels 40 and 42 also assist in the continual radial outward flow of air, as best illustrated in FIG. 4. The greater depth of the radially outer channel 40, in conjunction with the conical walls A' of both the channels 40 and 42, create a stepped, smooth, and non turbulent flow of air radially outwardly along the underside of the ring 24, as shown by the arrows. The steeper channel walls B' do not interfere with air flow, since they face radially outwardly.

Variations in the embodiments disclosed could be made. If the impeller blades were less steeply inclined, lying almost on straight radial planes like a paddle wheel, then the blade tips would be more nearly perpendicular to the channels. Therefore, if the blade tips were bent, the notch edges would have less inherent wedging or jamming action into the side walls of the channels, especially when the radius of curvature of the channels was relatively large. To compensate for that, it would be possible to constitute the channels not as simple circles or annuli, but as a series of short arcs, one for each blade tip, in a cauliflower type pattern. The short arcs would still all lie within a generally circular or annular envelope, however, and could still be integrally molded in the same way. Such a locking ring would have to be specifically oriented relative to the blade tips in order to align the peak of each short arc with a blade tip notch. This is an alignment that could be easily sensed by the operator, however. Once assembled, the notches would be well wedged against the surfaces of the individual, more sharply radiused arcs, and prevented from bending in either direction. The particular cross sectional shape of the notches 34 and 36 disclosed, with the sloping edges A, is not necessary just for the basic wedging action. Notches with two short, vertical side edges could be used, though the airflow past the matching channels would be less smooth. Conceivably, blade tip notches with a more square shape and greater depth, and which more closely matched the shape of the locking ring channels, or were even slightly narrower than, could be used. This would create a tighter interference fit to the locking ring channels, and could, by themselves, retain the locking ring axially to the blade tips, without a tight fitting, knurled band 38. It is a simple matter to mold the band 38, however, and it advantageously provides some blade tip stiffening, as well as retaining the locking ring axially.

We claim:

1. A centrifugal blower impeller, comprising, a central hub having a center axis and an annular rim, a regularly spaced series of substantially identical impeller blades extending axially upwardly from said hub rim, each blade having a substantially unsupported tip and a radial width sufficient to require external support to said blade tip to prevent excessive flexure in use, each blade tip further having a pair of radially separated, axially opening notches therein, each notch of each pair lying on a common diameter with the remaining blade tip notches, a circular band surrounding and integrally molded to said blade tips, said circular band being located entirely radially outboard of said hub rim, and, an annular locking ring having a radial width comparable to said blade tips, said ring having a pair of generally circular channels, each lying on a diameter equal to said blade tip notches and having a cross sectional shape matching the shape of said notches, said locking ring also having a cylindrical flange the inner surface of which closely matches the outer surface of said band, whereby said locking ring is assembled to said blades by aligning and axially inserting said cylindrical flange over said band as said channels are concurrently axially inserted into said blade tip notches, thereby completing said impeller and preventing said blade tips from flexing excessively during impeller rotation.

* * * * *